US005487224A

United States Patent [19]

Gabalda et al.

[11] Patent Number: 5,487,224

[45] Date of Patent: Jan. 30, 1996

[54] DEVICE FOR THE HEAT TREATMENT OF MOVING YARNS

[75] Inventors: Carlos M. Gabalda, Granges les Valence; Pierre Mirabel, Roanne, both of France

[73] Assignee: ICBT Roanne, France

[21] Appl. No.: 273,111

[22] Filed: Jul. 11, 1994

[30] Foreign Application Priority Data

Jul. 20, 1993 [FR] France ..... 93 09147

[51] Int. Cl.[6] ..... F26B 3/34

[52] U.S. Cl. ..... 34/266; 34/68; 34/624; 34/628; 219/388; 219/410; 432/128; 432/230

[58] Field of Search ..... 34/624, 628, 657, 34/636, 623, 68, 266; 219/388, 410; 432/121, 128, 153, 202, 207, 209, 228, 230

[56] References Cited

U.S. PATENT DOCUMENTS

| | | | |
|---|---|---|---|
| 2,299,239 | 10/1942 | Jordan et al. | 34/657 |
| 3,015,872 | 1/1962 | Jones . | |
| 3,063,124 | 11/1962 | Hilleary et al. | 219/388 |
| 4,753,777 | 6/1988 | Yoshinari et al. | 34/636 |
| 4,820,905 | 4/1989 | Iwata et al. | 219/388 |
| 5,193,293 | 3/1993 | Gabalda et al. . | |

FOREIGN PATENT DOCUMENTS

| | | | |
|---|---|---|---|
| 0524111 | 5/1992 | European Pat. Off. . | |
| 1204634 | 1/1960 | France . | |
| 4018200 | 2/1991 | Germany . | |
| 890057 | 2/1962 | United Kingdom . | |
| 987093 | 3/1965 | United Kingdom . | |
| 1135561 | 12/1968 | United Kingdom | 219/388 |
| 1149720 | 4/1969 | United Kingdom . | |

OTHER PUBLICATIONS

Hobourn Type E.P.1 Stretch Yarn Machine, pp. 80–85 (Applicant's best copy).

*Primary Examiner*—F. Daniel Lopez
*Attorney, Agent, or Firm*—Harris Beach & Wilcox

[57] ABSTRACT

Device for the heat treatment of moving yarns, during, for example, a texturizing stretching operation. The yarn is subject to two successive treatments, one at a high temperature, the other at a normal treatment temperature. The device is one wherein these successive phases are obtained by means of a heating unit formed by a cylindrical assembly comprising two heating zones on either side of which are provided guide means for the yarn. The zones are heated by means of two resistance elements embedded inside the cylindrical assembly. The two resistance elements are mounted in parallel, offset with respect to each other along the length of the unit, and each associated with a thermocouple element enabling temperature to be regulated accurately.

6 Claims, 5 Drawing Sheets

DEVICE FOR THE HEAT TREATMENT OF MOVING YARNS

BACKGROUND OF THE INVENTION

1. Field of the Invention

The present invention relates to an improvement made to devices for the heat treatment of moving yarns, especially the heat treatment of yarns so as to impart to them certain shrinkage and/or bulkiness and/or elasticity properties.

2. Discussion of the Related Art

In all yarn conversion processes requiring a heat treatment, the main problem which arises is that of rapid heat transfer, the heat having to rise uniformly in the core and in the same way over the entire length of the yarn. In fact, as is known, the temperature of the treatment and its uniformity have a very great influence on the quality of the yarn.

It is well known that heat treatment varies depending on the substance treated, on the yarn count and on the speed at which it passes through the oven. Thus, it is easily understood that the core is more rapidly reached with a fine yarn than one having a high count. Likewise, it is known that it is not possible to heat a yarn above a certain ceiling temperature, without it suffering degradation. Consequently, since this question of heat exchange is very important in the field of texturizing, very many solutions have been envisaged in order to solve it, these solutions involving the three great principles of heat exchange, namely convection, radiation, and conduction (direct contact with the heating surface).

Over and above this problem of good heat transfer there also arises that of keeping the yarn under a defined tension, depending on the treatment which takes place. Thus, for example, in the case of a stretching operation, possibly combined with a texturizing operation, it is necessary that the yarn be kept under a maximum tension, while on the other hand, when it is desired to shrink the yarn, the tension has to be reduced. Finally, the problem also arises of increasing the production speeds on a textile machine, this having passed from a few tens of meters per minute thirty or so years ago to a thousand meters, or even more, today, and this has had the consequence of leading to very sizable installations, ovens becoming longer and longer, possibly reaching as much as two meters long.

Among the various solutions proposed for obtaining very good uniformity of heat transfer and also for easing the problems of temperature regulation from position to position on a machine so that the entire production is homogeneous, it has for a very long time been envisaged to carry out heat treatments which could be termed "sequential", by producing ovens along the length of which there is a plurality of separate heat treatment zones following one after the other. Among these solutions, mention may be made of the one forming the subject of the French Patent No. 1,204,634 (corresponding to the U.S. Pat. No. 3,015,872) in which two successive treatments are carried out inside one and the same oven, one during which the yarn is subjected to a temperature considerably higher than that of the normal temperature to which it has to be heated, and this for a time such that it is not damaged, this first phase being followed by an equilibrating treatment at a temperature heating the yarn at a conventional temperature.

Such a solution, used industrially since 1953 on machines marketed by the Company HOBOURN AERO COMPONENTS Ltd., under the reference "HOBOURN—E.P.1", which is attractive because it enables the length of the ovens to be considerably decreased for a given run speed, has, however, been abandoned for a very long time by the manufacturers of textile equipment, which may be explained by the fact that it required apparatuses of complex design which were difficult to operate.

OBJECTS AND SUMMARY OF THE INVENTION

Now, a novel type of oven of particularly simple design has been found, and it is this which forms the subject of the present invention, which oven not only enables such "sequential" heat treatments to be carried out, but also offers the special feature of being able to be easily adapted, depending on the treatments to be carried out and on the nature of the yarns to be treated, in order to have successive zones in which the transfer of heat to the yarns may be achieved by combining, along its length, zones employing the various principles of heat exchange and, more particularly, successive zones in which the heat transfer takes place by radiation or conduction.

Such an oven design also enables the risk of vibration, which can lead to non-uniformities in the yarn production, to be virtually completely eliminated and allows high production speeds, while still having a particularly compact heater assembly.

In general, the novel type of oven in accordance with the invention, for the heat treatment of a yarn, for example during a texturizing stretching operation, is of the type formed by an insulating chamber which surrounds a heating unit with which it defines a "channel" which can be open to the outside, through which the yarn to be treated passes. The oven is provided with elements for guiding the yarn being provided for positioning it inside the oven, and in which the moving yarn is subjected to two successive treatments, one during which the temperature is greater than that of the normal temperature to which it has to be heated, and this for a time such that it is not damaged, the first phase being followed by an equilibrating treatment at a temperature heating the yarn to a conventional temperature, and is one wherein these successive phases are obtained by means of a heating unit formed by a cylindrical assembly comprising two heating zones, on either side of which are provided guide elements for the yarn, the zones being obtained by means of two resistance elements embedded inside the cylindrical assembly, these being mounted in parallel, offset with respect to each other along the length of the unit and each associated with a thermocouple element enabling the oven temperature to be regulated accurately.

By virtue of such a design, two separate heating zones are therefore obtained, one able to be at a high temperature and the other at a lower temperature, therefore making it possible to have a rapid temperature rise in the yarn to a level close to its optimum treatment temperature, followed by a stabilizing phase at the optimum yarn-treatment temperature.

Although it may be envisaged to carry out a heat treatment solely by radiation, the cylindrical unit then only containing at least three yarn-guiding elements (rings), one at the inlet, one at the outlet and one on its central part, according to a preferred embodiment, it is designed to enable the two types of heat treatment, using convection and conduction, to be combined in accordance with the teachings of the European Patent No. 0,524,111 in the name of the Applicant, and containing a large-diameter zone (sleeve) against which the yarn is in contact, preferably in a helical path.

According to one variant, the cylindrical heating unit is associated with two "sleeves" of the same diameter, preferably separated from each other, the yarn being tangential, preferably helically, with the surfaces of the sleeves, therefore making it possible to have heat exchange by contact (conduction), these sleeves being separated from each other by a zone in which the yarn is heated by radiation.

Finally, although the resistance elements may transfer their heat directly to the units inside which they are mounted, it would be possible to envisage, in order to achieve the heating, to arrange the resistance elements in a second chamber containing a DOWTERM liquid.

From a practical standpoint, according to a preferred embodiment in accordance with the invention, the heating unit is formed by a ceramic or stainless steel cylinder, the two electrical resistance elements being embedded inside this cylinder and each being associated with a thermocouple element, the electrical supply and the connections of the thermocouple elements being located on one and the same face.

Moreover, although such an oven may be used for treating a single yarn, it may also be designed so as to be able to treat two yarns simultaneously, the two yarns being kept separate inside the oven either by means of suitable guide elements or, possibly, by producing grooves at the very surface of the "sleeve" of the zone or zones where the heat transfer is achieved by contact.

BRIEF DESCRIPTION OF THE DRAWINGS

The invention and the advantages which it provides will, however, be better understood by virtue of the exemplary embodiments given hereinbelow by way of non-limiting indication and which are illustrated by the appended diagrams in which.

DETAILED DESCRIPTION OF THE PREFERRED EMBODIMENTS

Figure 1:
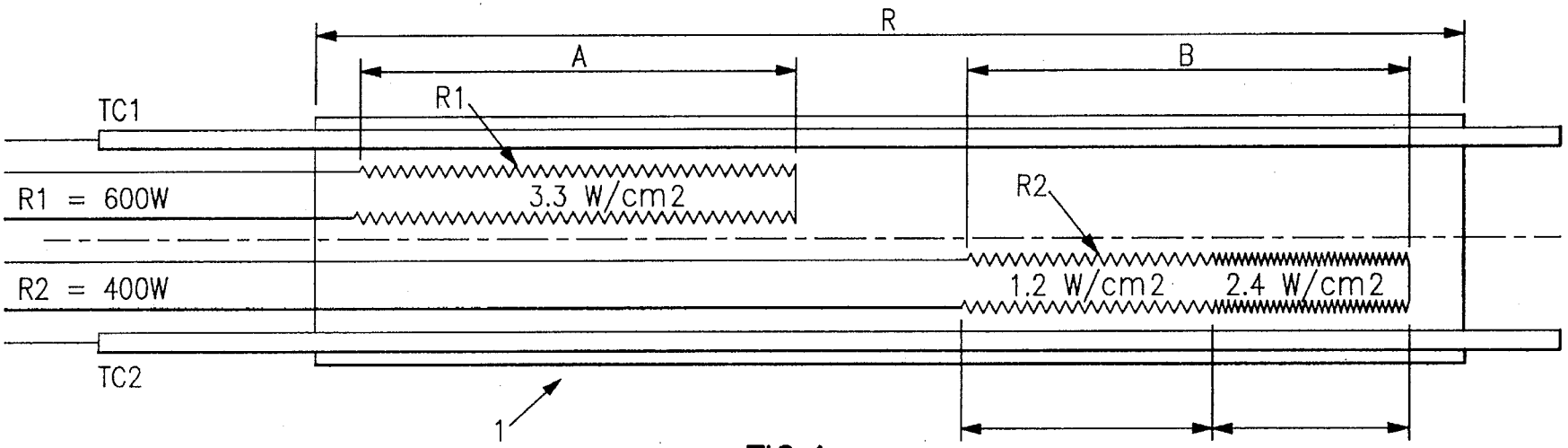
FIGS. 1 and 2 are diagrammatic views, respectively in elevation and in section, and in side view of a heating unit produced in accordance with the invention and enabling two successive temperature zones to be obtained along the length of the actual oven.
Figure 2:
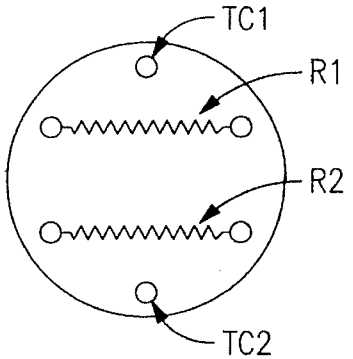

FIGS. 1 and 2 illustrate the structure of the heating unit enabling the novel type of oven in accordance with the invention to be produced, this being essentially formed by a cylindrical core, designated by the general reference (1), made of a material which is a conductor of heat, for example steel. This unit (1) is brought up to temperature, in accordance with the invention, by means of two resistance elements (R1,R2), each associated with the thermocouple element TC1, TC2, and mounted in parallel and positioned in an offset manner along the length of said unit (B). These two resistance elements (R1,R2) enable two different temperature zones to be created along the length of the unit, thus offering the possibility of carrying out a heat treatment of the "sequential" type.

The two resistance elements (R1,R2) therefore make it possible to create, over the length of the unit (1), two zones (A,B) which can have different temperatures, the zone (A) corresponding to the resistance element (R1) and the zone (B) to the resistance element (R2). Each resistance element has a structure designed so that the unit is heated to a high temperature (between 400° and 700° C.) in the zone (A), and to a low temperature, corresponding to the optimum temperature for treating a synthetic yarn (between 150° and 250° C.) in the zone B. Moreover, these resistance elements (R1 and R2) may either have a structure such that they dissipate power uniformly over their entire length or, as is apparent from FIG. 1, be designed so that the resistance element dissipates a power which varies along its length, for example a lower power in a first part and a higher power in the final phase.

By way of indication, a 600-watt resistance element (R1), designed to dissipate, over its length R1, a power of 3.3 watts per centimeter squared, and a 400-watt resistance element R2, designed to dissipate, over its length, on the one hand, a power of 1.2 watts per $cm^2$ in a first zone and, on the other hand, a power of 2.4 watts per $cm^2$ in its end zone, is suitable for all applications.

Moreover, according to the embodiment illustrated, the thermocouple elements TC1, TC2 are arranged inside a conduit, which extends over the entire length of the heating unit (1). This therefore possibly enables the temperature inside a control thermocouple element, which is inserted via the free end of said conduits, to be checked. It should also be pointed out that, according to the preferred embodiment in accordance with the invention, the electrical connections and the outputs of the thermocouple elements are located on one and the same face.

Figure 3:
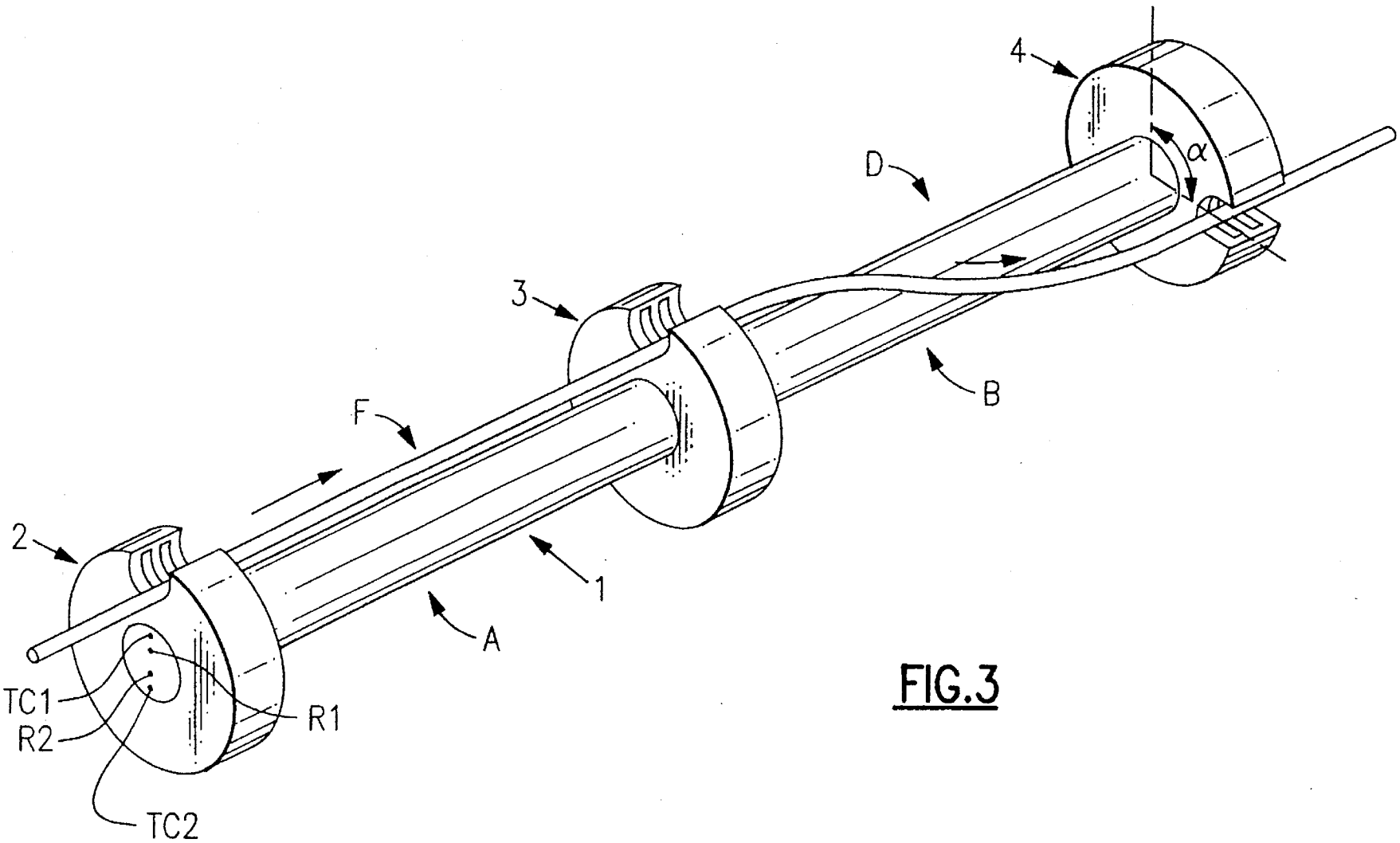
FIGS. 3 and 4 are respectively perspective and elevation views of a heating unit in accordance with the invention, used for producing an oven as described in the European Patent 0,524,111 of the Applicant.
Figure 4:
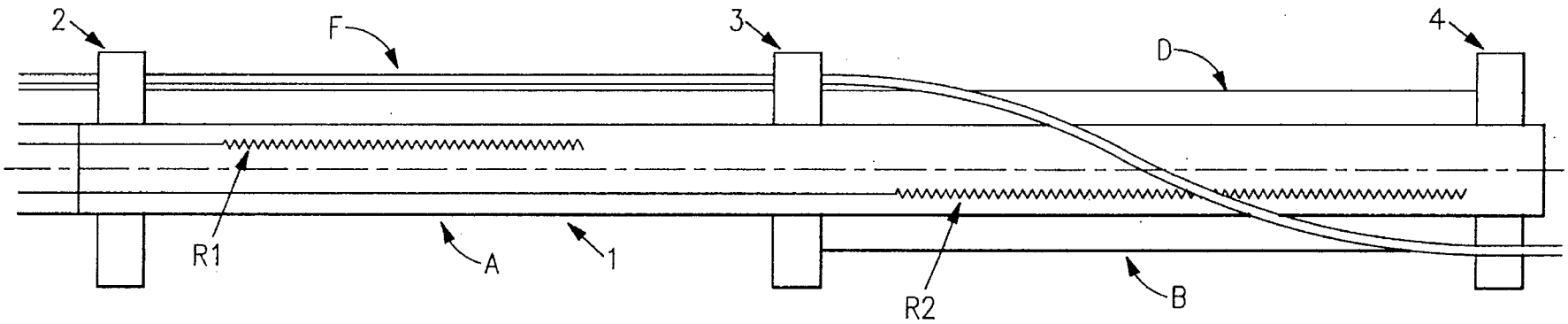

In the embodiment illustrated by FIGS. 3 and 4, the unit is associated with yarn-guiding elements formed by rings (2, 3, 4) positioned at the inlet, in the central part and at the outlet of the oven, and a cylindrical surface-treated steel or ceramic sleeve D is arranged along the length of the zone B corresponding to the resistance element R2. The guide elements (2, 3, 4) are designed so that, in the zone A, the yarn F is away from the heating unit (1) and is therefore heated by radiation, whereas, in the zone B, said yarn (F) is tangential with the surface of the sleeve D and is then therefore heated by contact, said treatment therefore taking place in a similar way to the teachings of the European Patent 0,524,111, except that, in the zone A, a rise in temperature of the yarn to a level close to its optimum treatment temperature is obtained followed, in the zone B, by a phase of stabilizing at said optimum yarn-treatment temperature.

Figures 5, 6:
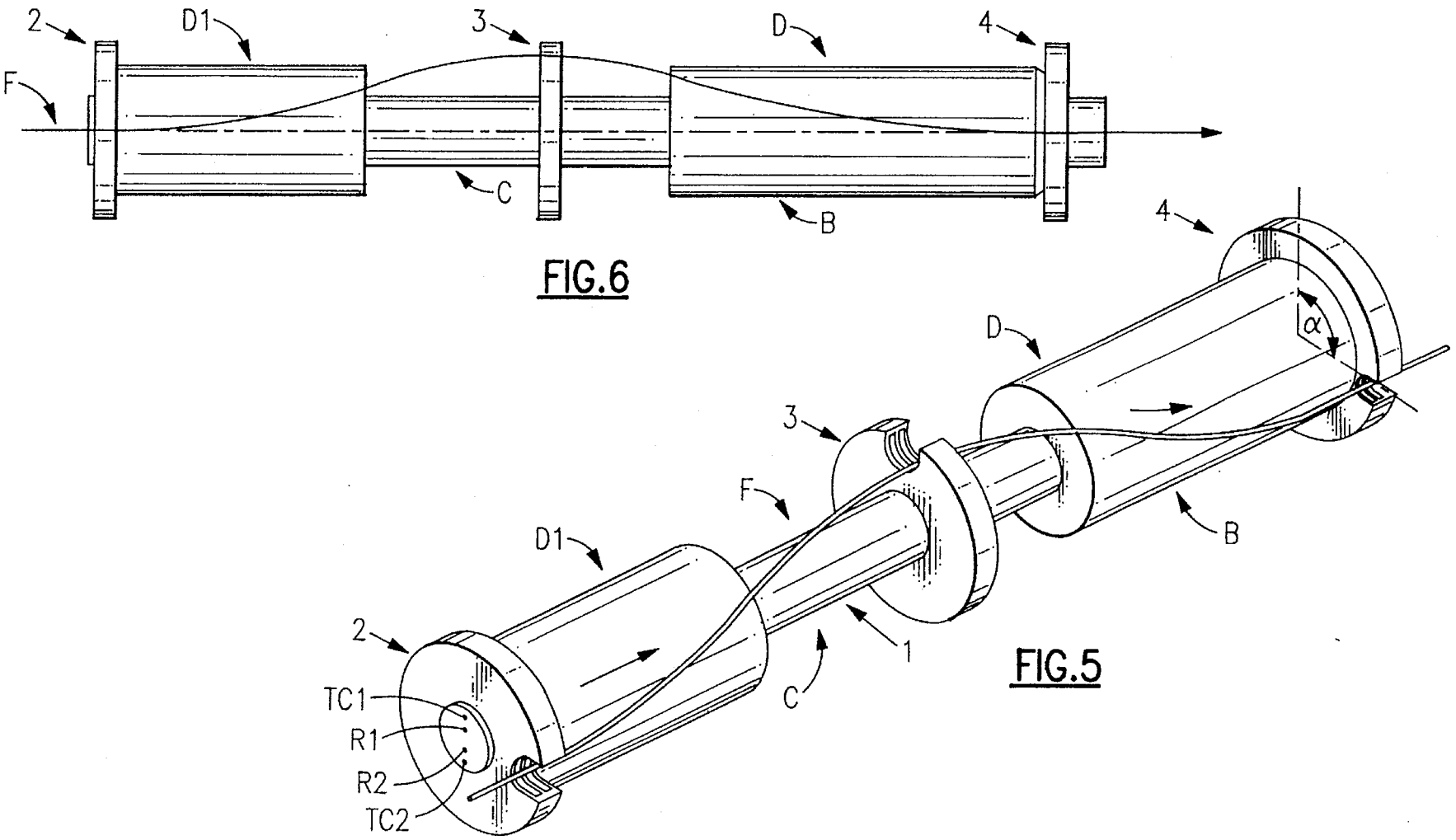
FIGS. 5 and 6 also illustrate, in perspective and in elevation, another embodiment of an oven by means of a unit in accordance with the invention and in which the heat treatment takes place using two contact zones separated from each other by a radiation zone.

FIGS. 5 and 6 illustrate another type of oven produced using a heating unit in accordance with the invention, containing a second sleeve D1 arranged around the heating unit, along the length corresponding to the zone A, away from the resistance R1. In this way, an oven is obtained in which the temperature rise takes place at first by contact in the zone corresponding to the sleeve D1, followed by a zone C, of length which can be varied, for heating by radiation and by a zone (zone B) for stabilizing by contact.

It should be pointed out that, in this embodiment, the guide rings (2, 3, 4) are positioned in such a way that the yarn (F) is tangential, in a helix, against the two surfaces D1,D2, ensuring perfect contact and preventing vibration phenomena.

Figure 7:
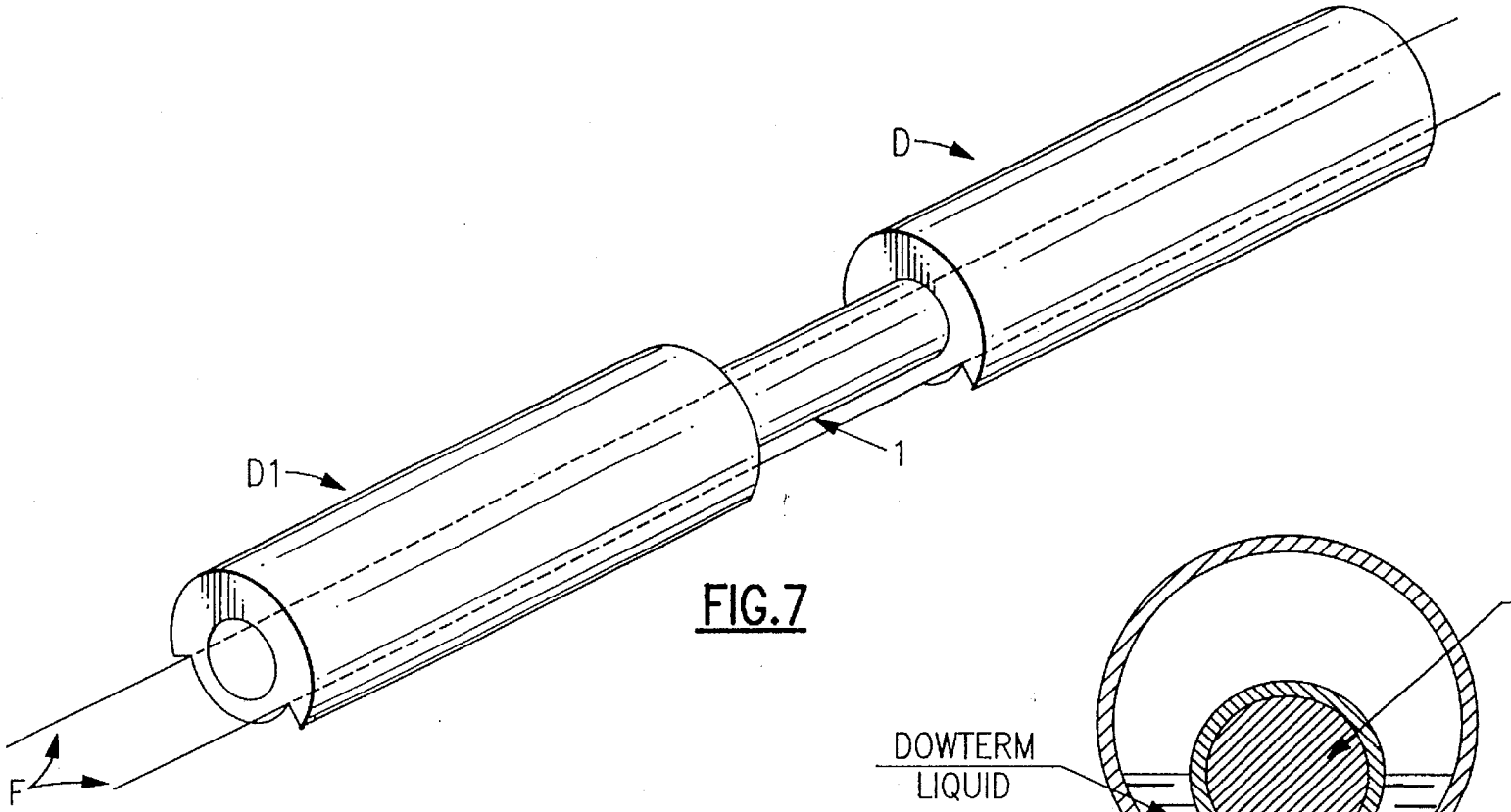
FIG. 7 illustrates a variant of an oven containing contact heating zones separated by the radiation zone, making it possible to treat two yarns simultaneously and to guide them automatically without the addition of extra guide elements along the length of said oven.

Although in the previous example the yarn guiding in the oven is achieved by means of rings, it could be envisaged to use other means, for example as shown in FIG. 7, producing helical grooves, depthwise, in the very surface of the sleeves which are attached around the actual heating unit.

Figure 8:
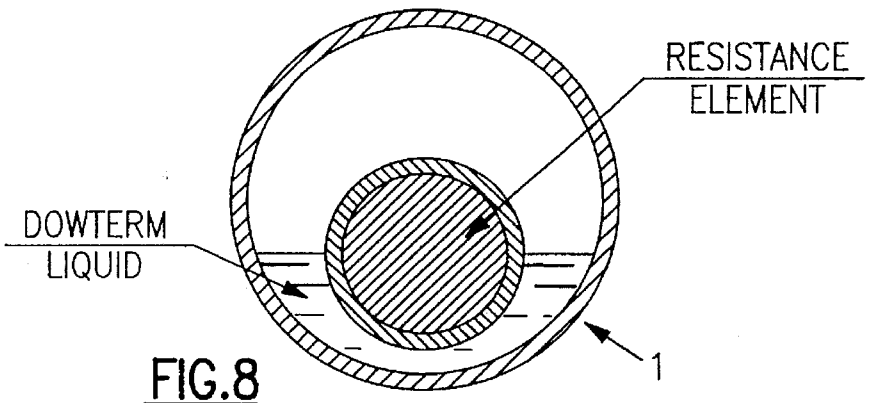
FIG. 8 illustrates a variant of the way in which heating is achieved.

Moreover, the creation of two temperature zones along the length of the oven could be achieved in another way, for example, as illustrated in FIG. 8, by arranging each resistance element R1, R2 inside an additional chamber containing the DOWTERM liquid.

Such a design of heating element is more particularly adapted for producing ovens for texturizing machines, especially false-twisting machines, compact ovens enabling all types of synthetic yarns, such as polyamide, polyester, etc., to be treated. In such ovens, the two treatment zones A,B may either have the same lengths or have different lengths. By way of non-limiting indication, in ovens having a length of one meter, the sections A,B may be respectively 350 mm and 450 mm in length.

While this invention has been described in detail with reference to certain preferred embodiments, it should be appreciated that the present invention is not limited to those precise embodiments. Rather, in view of the present disclosure which describes the best mode for practicing the invention, many modifications and variations would present themselves to those of skill in the art without departing from the scope and spirit of this invention, as defined in the following claims.

What is claimed is:

1. A device for heat treating a moving yarn comprising an insulating chamber, guide means and a cylindrical heating unit, said heating unit being surrounded by said insulating chamber and comprising two heating zones obtained by embedding two resistance elements inside said heating unit, parallel, but offset with respect to each other; with each heating zone including an associated thermocouple element associated with a respective one of said two resistance elements;

said insulating chamber defining a channel through which said yarn passes and said guide means positioning said yarn within said channel, wherein said guide means are provided on either side of each heating zone; and wherein said yarn first enters a first of said heating zones, which is set to a temperature greater than a normal temperature to which said yarn is to be heated, for a length of time such that said yarn is not damaged, and said yarn subsequently enters a second of said heating zones set at said normal temperature.

2. The device as claimed in claim 1 wherein the heating unit contains a large-diameter zone formed by a sleeve against which the yarn is in contact in a helical path.

3. The device as claimed in claim 1 wherein the cylindrical heating unit includes two sleeves of a same diameter, said sleeves separated from each other and the yarn being helically tangential with surfaces of said sleeves thereby making it possible to have heat exchange by contact separated by a zone in which the yarn is heated by radiation.

4. The device as claimed in claim 1 wherein the heating unit is formed by a ceramic or stainless steel cylinder, said two electrical resistance elements being embedded inside said cylinder with electrical supply and connections of the thermocouple elements being located on one end face of the unit.

5. The device as claimed in claim 1 wherein said heating unit channel is adapted to treat two yarns simultaneously, the two yarns being kept separate inside said channel by said guide means.

6. The device as claimed in claim 5 wherein said guide means include grooves formed on a surface of a sleeve providing a zone in which heat transfer is achieved by contact.

* * * * *